US006493879B1

(12) United States Patent
Hibler

(10) Patent No.: US 6,493,879 B1
(45) Date of Patent: Dec. 17, 2002

(54) REUSABLE PROTECTIVE OVERLAY WITH PRESSURE ADHESIVE BACK

(76) Inventor: Stanley A. Hibler, 5491 San Gabriel Dr., Apt. B, Columbus, OH (US) 43213

( * ) Notice: Subject to any disclaimer, the term of this patent is extended or adjusted under 35 U.S.C. 154(b) by 0 days.

(21) Appl. No.: 08/308,279

(22) Filed: Sep. 19, 1994

(51) Int. Cl.[7] ..... A41B 13/10
(52) U.S. Cl. ..... 2/49.1; 2/49.5
(58) Field of Search ..... 2/46, 48, 49.1, 2/49.2, 49.3, 49.4, 49.5, 50, 51, 52, 104, 105, 106, 113, 114, 115, 243.1, 244, 60, 53, 119; 206/820, 390, 499; 428/79, 40, 40.1, 41.3, 41.5, 41.7, 41.8, 42.01, 42.02, 42.3; 40/1.5, 630, 638

(56) References Cited

U.S. PATENT DOCUMENTS

| | | | | | |
|---|---|---|---|---|---|
| 2,145,139 | A | * | 1/1939 | Scharfenberg | 2/46 |
| D143,406 | S | | 1/1946 | Contriscigni | D3/26 |
| 2,411,238 | A | * | 11/1946 | MacNab | 2/243.1 |
| 2,461,430 | A | | 2/1949 | Mack | 2/49 |
| D155,752 | S | * | 10/1949 | Vivaudou | 2/49.4 |
| 2,763,867 | A | * | 9/1956 | Chagnon | 2/49.1 |
| 2,902,734 | A | * | 9/1959 | Walters | 2/52 |
| 3,067,428 | A | * | 12/1962 | Baker et al. | 2/50 |
| 3,200,413 | A | * | 8/1965 | Vaughan | |
| 3,727,236 | A | * | 4/1973 | Lloyd et al. | 2/51 |
| 3,815,153 | A | * | 6/1974 | Vitol | 2/51 |
| 3,902,955 | A | * | 9/1975 | West | 156/513 |
| 3,979,776 | A | | 9/1976 | Gruenwald | 2/49 |
| 4,330,888 | A | | 5/1982 | Klepfer | 2/48 |
| 4,590,109 | A | * | 5/1986 | Holmberg | 428/40 |
| 4,646,364 | A | * | 3/1987 | O'Larey | 2/50 |
| 4,653,119 | A | * | 3/1987 | Kaiser | 2/60 |
| 4,660,224 | A | | 4/1987 | Ashcraft | 2/48 |
| 4,660,226 | A | * | 4/1987 | Quilling et al. | 2/49.2 |
| 4,666,441 | A | * | 5/1987 | Andriola et al. | 604/897 |
| 4,797,952 | A | | 1/1989 | Petrini | 2/49 |
| D303,175 | S | | 9/1989 | Wilson et al. | D2/227 |
| 4,862,518 | A | | 9/1989 | Williams et al. | 2/49 R |
| 4,882,211 | A | * | 11/1989 | McIntyre et al. | 428/40 X |
| 4,884,826 | A | * | 12/1989 | Slagvol | 428/40 X |
| 4,930,234 | A | * | 6/1990 | Schmidt | 40/1.5 |
| 4,951,658 | A | * | 8/1990 | Morgan et al. | 128/163 |
| 4,995,514 | A | * | 2/1991 | Forschner | 206/574 |
| 5,031,241 | A | * | 7/1991 | Wiedemann | 2/49 R |
| 5,268,222 | A | * | 12/1993 | Honeycutt | 428/224 |
| 5,286,546 | A | * | 2/1994 | Su | 428/40 X |
| 5,326,305 | A | * | 7/1994 | Fochler | 450/57 |
| 5,418,978 | A | * | 5/1995 | Hochman | 2/69 |
| 5,491,844 | A | * | 2/1996 | Kehl et al. | 2/49.1 |
| 5,534,346 | A | * | 7/1996 | Robinson | 428/343 |
| 5,640,716 | A | * | 6/1997 | Oldham | 2/49.1 |
| 5,881,382 | A | * | 3/1999 | Bernard et al. | 2/49.1 |
| 5,950,236 | A | * | 9/1999 | Andrew et al. | 2/50 |

FOREIGN PATENT DOCUMENTS

| | | | | |
|---|---|---|---|---|
| DE | 3207883 | * | 9/1983 | 2/49.1 |
| FR | 2626446 | * | 8/1989 | 2/46 |

* cited by examiner

*Primary Examiner*—A Vanatta
(74) *Attorney, Agent, or Firm*—Mueller and Smith, LPA

(57) ABSTRACT

A self-adhering protective overlay employing a flexible sheet having a front surface, a back surface, and a periphery, with a pressure sensitive adhesive applied substantially to the periphery on the back surface. In one embodiment, a release sheet is removably adhered to the pressure sensitive adhesive prior to use After the release sheet is removed, the flexible sheet may be used and re-adhered to the release sheet for subsequent use. In an alternate embodiment, a plurality of protective overlays, without the addition of the release sheet, are arranged in a stack wherein individual flexible sheets may be separated from the stack, used, and then disposed or re-adhered to the stack for subsequent use.

14 Claims, 1 Drawing Sheet

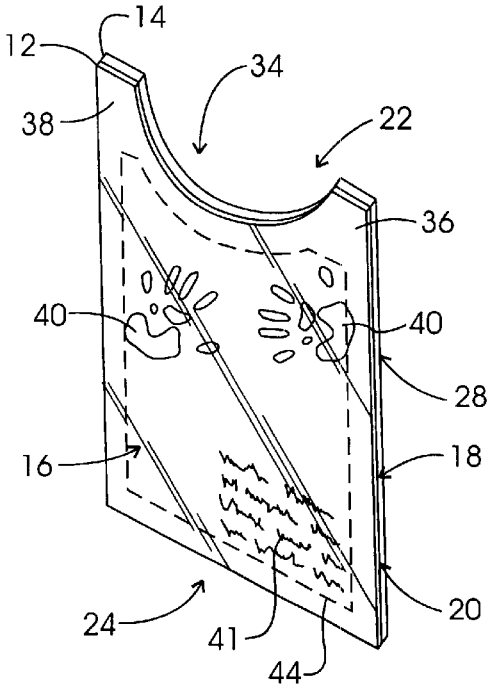
FIG. 1
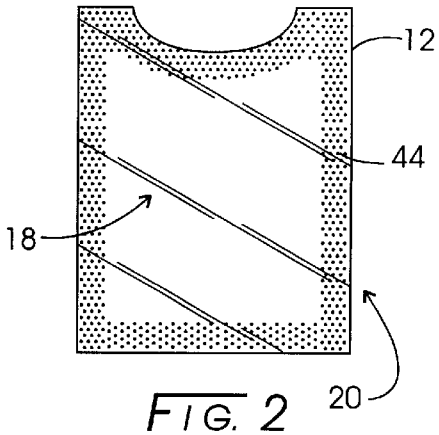
FIG. 2
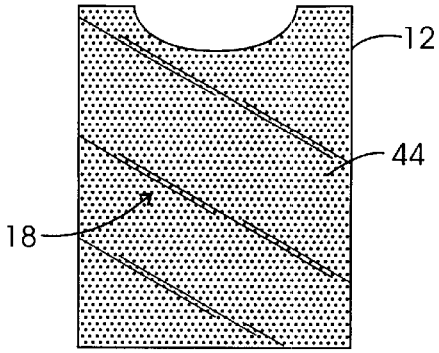
FIG. 3
FIG. 4
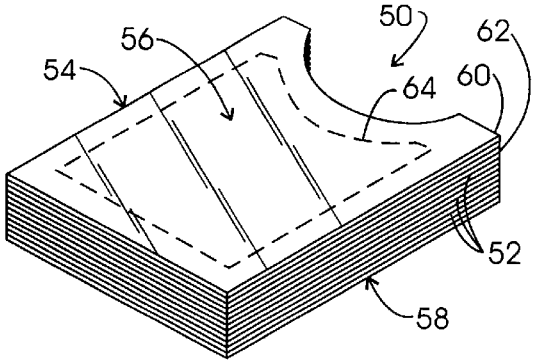
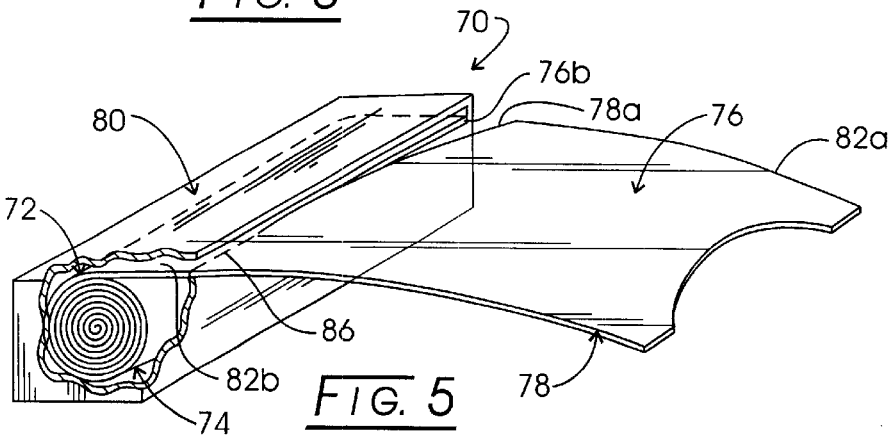
FIG. 5

REUSABLE PROTECTIVE OVERLAY WITH PRESSURE ADHESIVE BACK

BACKGROUND OF THE INVENTION

Anyone who has fed an infant or had the opportunity to observe a baby eat knows all too well the difficult task of getting food into the child's mouth. Quite often, the goal in feeding an infant is simply to get more food into his or her mouth than on the child and surrounding eating area. Food, almost inevitably then, finds its way onto the child's clothes which can soil and permanently stain the clothing. Bibs, therefore, are often used to minimize the scattering of food and to protect the child's clothing from food stains.

Conventional bibs are formed from cloth or other absorbent material and typically have two strings which tie around the child's neck to hold the bid in place. Other bibs are formed from plastic and use snaps, ties, strings, hook and loop fasteners, or the like to attach around the child's neck. More recently, some bibs have eliminated the strings and ties altogether and have instead used adhesive strips. These strips are located near the shoulder area on the backside of the bib and are used to adhere the bib to the wearer.

Particularly with younger children and infants, the bibs heretofore known in the art have not always adequately kept food and other stains from reaching the child's clothing. One common problem encountered with feeding infants, in particular, is keeping the bib on the front of the child in an orientation which actually protects the clothing. This task is not always that simple. Infants almost instinctively tend to put everything in their mouth. Often, then, the first thing an infant wants to do is remove the bib from its useful location to his or her mouth. In other instances, the infant or child simply may not want to wear the bib and attempt to move it. Even children capable of feeding themselves may, after determining they are finished, reach down to prematurely remove their bib. The removal of the bib, however, may occur before the child's hands, face, and eating area have been cleaned. In other instances, the bib may accidentally catch on the child's hand or otherwise lift up and expose the child's clothing to food. In these situations, an extra hand for a parent, baby sitter, or care taker faced with the responsibility of holding the bib down with one hand and feeding the child with the other would be helpful. Since such added help, or extra hands, are typically not available, food often ends up on the infant and the infant's clothes despite the bib.

Another prior encountered problem is that many bibs are unable to effectively and completely prevent food and saliva from staining the infant's cloths near the neck region. infants, for example, cannot easily control salivation, and it is not uncommon for food and saliva to run down their cheek to their clothes through openings in the neck portion of the bib. Many bibs use strings, ties, straps, or the like to fasten around the baby's neck. In order to assure a comfortable fit, however, the bib must be fastened somewhat loosely, so as not to choke the child. Inevitably then, a gap is created through which food may fall or drop. A similar problem exists with bibs that use adhesive straps to secure the bib to the infant. These bibs commonly only have adhesive at the shoulder areas. As such, food may pass through openings along the neck portions which are not directly adhered to the overlay.

Compared to children, adults are much less apt to spill or splatter food onto their clothing. Napkins, then, are typically used instead of bibs to protect clothing. However, certain foods, such as shelled lobster and spaghetti, tend to be quite messy even for adults eating with care. In these situations, a napkin may not adequately keep food off clothing. Bibs would be practical but are often not used because of the stereotype associated with wearing a bib. A bib which not only fully protects the wearer but also remains inconspicuous would be especially welcome by adult diners.

Prior bibs are either disposable or reusable. Cloth and plastic bibs, for example, may be washed or rinsed off after each use. These reusable type bibs are advantageous in that they are durable and suited for frequent re-use. These bibs are also economical since a single bib may be repeatedly washed and used. Disposable bibs, such as those made from thin thermoplastic material, are discarded after becoming soiled. These bibs are economical in that they are very inexpensive to purchase and may be disposed after one use without great cost. At present, a bib which is both reusable and disposable after being soiled would, if inexpensively manufactured, enjoy the attributes of both the disposable and reusable bibs.

In view of the foregoing, parents and care givers of infants, as well as adults, would welcome a bib which securely adheres to the wearer yet is inexpensive and is both disposable or reusable.

SUMMARY OF THE INVENTION

The present invention is directed to a self-adhering protective overlay such as a bib, apron, napkin, or the like which securely adheres to a wearer or wearer's clothes without the addition of snaps, ties, strings, or the like. A flexible sheet is employed which has a front surface, a back surface, and a periphery. A pressure sensitive adhesive (PSA) is applied to substantially all of the periphery on the back surface for adhering the flexible sheet to the wearer. Once this adhesive is adhered to the wearer, the protective overlay may not readily be removed and, as such, is particularly advantageous for use on infants and small children.

In one embodiment, a removable release sheet is adhered to the pressure sensitive adhesive prior to use for protecting against unwanted adhesion. After the release sheet is removed, the flexible sheet may be used and then re-adhered to the release sheet for subsequent use. Alternatively, once the flexible sheet is used, it may be discarded.

As an additional advantage, the protective overlay may be manufactured from a durable, lightweight material which is extremely inexpensive. Further, graphics such as designs, emblems, prints, or alpha-numeric characters may be placed or printed on the protective overlay to enhance its aesthetic value. Alternatively, the protective overlay may be transparent so that it is virtually unnoticeable when worn.

As another feature, a plurality of flexible sheets are arranged to form a protective overlay dispensing system. In this system, flexible sheets, without the addition of the release sheet, are arranged in a stack. Individual sheets may be removed from the stack, used, and re-adhered to the stack for subsequent use. In one embodiment, the flexible sheets are superimposed on one another to form a vertical stack. In another embodiment, the flexible sheets are attached at adjacent ends to form a rolled stack.

Other objects of the invention will, in part, be obvious and will appear hereinafter. The invention, accordingly, comprises the apparatus and method possessing the construction, combination of elements, and arrangements of parts which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIG. 1 is a perspective view of one embodiment of a protective overlay according to the present invention which employs a release sheet and a flexible sheet;

FIG. 2 is a back view of one embodiment of a flexible sheet of FIG. 1;

FIG. 3 is a back view of an alternative embodiment of the flexible sheet of FIG. 2;

FIG. 4 is a perspective view of one arrangement wherein the flexible sheets of FIG. 2 are superimposed to form a vertical stack; and FIG. 5 is a perspective view of an alternate arrangement wherein the flexible sheets of FIG. 2 are attached at adjacent ends to form a rolled stack.

The drawings are described in detail below.

DETAILED DESCRIPTION OF THE INVENTION

Foods and drinks tend to stain clothes, and in some instances, these stains are not readily removed. During meals and eating time, then, protective overlays such as bibs, napkins, aprons, or the like are commonly worn around the neck, on the lap, over the shoulder, or on the chest over clothing to protect from unwanted contact with food or drink. The present invention is directed toward such a protective overlay.

Looking to FIG. 1, a protective overlay system 10 is shown according to one embodiment of the invention. Protective overlay system 10 has a flexible sheet 12 and a release sheet 14. Flexible sheet 12 is used to protect wearers, such as persons, the clothing of a person, or other surfaces. This flexible sheet, for example, may be employed as a protective overlay such as a bib, napkin, apron, garment, or the like. Alternatively, it may be used as a place mat, table cloth, or other such protective overlay.

Flexible sheet 12 has a front surface 16 and a correspondingly oppositely disposed back surface 18. Together, these surfaces 16 and 18 have a periphery or outer edge 20 which, in turn, defines an elongated, generally rectangular configuration. Flexible sheet 12 is seen to further have a top portion 22, a bottom portion 24, and two side portions 26 and 28. Bottom portion 24 and side portions 26 and 28 have straight edges which form the bottom and sides, respectively.

Bibs generally are worn on the front chest area of a wearer to extend downwardly from the neck region of the wearer. In this regard, flexible sheet 12 is shown in an exemplary embodiment in FIG. 1 as a bib. Top portion 22 is shaped to fit the neck region of a wearer. A neck recess portion 34 is provided between two shoulder portions 36 and 38. Neck recess portion 34 fits around the neck of the wearer and is shown to have a U-shape or semi-circular configuration. Shoulder portions 36 and 38 extend vertically from top portion 22 and are oppositely disposed and adjacent neck recess portion 34. The dimensions of shoulder portions 36 and 38 correspond to fit on the chest or front shoulder area of the wearer. Although the protective overlay of FIG. 1 is shown to be worn as a bib around the neck, other shapes may be employed, for example, to protect different locations on the wearer, to accommodate for differently sized wearers, such as children or adults, or to protect different surfaces, such as a table top.

Bibs and the like are worn to protect wearers, and in particular, clothing from food, drink, soil, and related stains. In this regard, flexible sheet 12 may be formed of various materials which protect wearers from food, drink, and soils. Protective overlay system 10, for example, may be made from multi-ply paper stock, cloth, polymers, or other suitable material, alone or in combination, for protecting the wearer. For example, front surface 16 of flexible sheet 12 preferably is made of a material sufficient to inhibit the penetration of food, drink or soil to the clothing of the wearer such absorbent paper, thermoplastic, or other polymeric material. Preferably, flexible sheet 12 is formed from Tyvek® spunbonded olefin (a random mat of bonded high density polyethylene fibers, 0.5–10 micrometers, E.I. duPont deNemours and Company, Wilmington, Del.). Alternatively, flexible sheet 12 could be formed from Reprofilm® sheet (1 mil clear polyester matte top coat with acrylic permanent adhesive, Rayven, Inc., St. Paul, Minn.). Additionaly, flexible sheet 12 could be formed from Sontera® spunlaced fabric (100% polyester, 70% rayon/30% polyester, or 55% woodpulp/45% polyester fabric, E.I. du Pont de Nemours and Co., Old Hickory, Tenn.).

As shown at 40, graphics such as decorative designs, prints, alpha-numeric characters, or the like may be placed or printed on front surface 16 to improve the aesthetics of flexible sheet 12. Additionally, flexible sheet 12 may be made in a variety of colors or, alternatively, made transparent. Transparent flexible sheets are advantageous in that they are virtually inconspicuous when worn and, as such, may be worn by adults or children. Flexible sheets of nominally 1 mil or so thickness contribute to their inconspicuous nature due to their being light in weight. The inventive sheets are virtually unnoticeable to the wearer.

FIG. 1 additionally shows instructions relating to the use of flexible sheet 12 for protecting the wearer. Instructions 41 may be packaged with protective overlay system 10 and, for example, printed directly on either flexible sheet 12 or release sheet 14. Alternatively, instructions 41 may be printed on a separate sheet (not shown) or otherwise supplied with flexible sheet 12 or protective overlay system 10.

FIG. 2 shows a back view of flexible sheet 12 wherein a pressure sensitive adhesive 44 is applied to back surface 18. Pressure-sensitive adhesive 44 enables flexible sheet 12 to be adhered or affixed to the wearer or wearer's clothes. As such, the addition of snaps, ties, strings, or the like are not necessary.

As shown in FIG. 1, prior to use, release sheet 14 is adhered to pressure sensitive adhesive 44 (shown as a dashed line) on back surface 18. While release sheet 14 is adhered, protective overlay system 10 may be stored or otherwise handled without exposing pressure sensitive adhesive 44 to unwanted adhesion. Thereafter, release sheet 14 may be quickly and easily removed and separated from back surface 18. While release sheet 14 is removed, pressure sensitive adhesive 44 of flexible sheet 12 may be adhered to the wearer for use.

Pressure sensitive adhesives are a class of adhesives that exhibit initial tack and peel performance when pressure-applied to a substrate. When the PSA coated sheet is removed from the substrate, removal must be clean, i.e. no visible trace of the adhesive should remain on the substrate. Reuse of the PSA coated sheet, accordingly, is contemplated. Most PSA compositions are based on one or more acrylate compounds optionally admixed ethylene, acrylamide, and like compounds. PSA compositions are replete in the art and widely available commercially.

One important feature of this invention is that flexible sheet 12 may be soiled and thereafter cleaned and reused numerous times. After flexible sheet 12 has been soiled with food, for example, it may be washed with soap and water or wiped off and then reused. In this regard, flexible sheet 12 is durable so as to withstand numerous cleanings, and after each use it may be re-adhered to release sheet 14 and stored for subsequent use. Alternatively, after flexible sheet 12 has been used, it, along with release sheet 14, may be thrown away or otherwise disposed. Protective overlay system 10 is manufactured inexpensively and therefore may be disposed or discarded without substantial cost.

Another important feature is that flexible sheet 12 securely adheres to the wearer and may not thereafter be easily removed. Infants, toddlers, and small children, who require a bib during feeding, are prone to remove their bib or otherwise adjust its position, either accidentally or purposely. Flexible sheet 12, however, is not prone to facile removal or repositioning. Its light weight also makes it unnoticeable to the toddler wearers so that they readily forget that they have it on. FIG. 2 reveals one embodiment in which pressure sensitive adhesive 44 is applied to substantially all of periphery 20 on back surface 18. Pressure sensitive adhesive 44 may have, for example, a width of at least about one inch (2.54 cm). Once flexible sheet 12 is adhered to the wearer, substantially all of periphery 20, including all corners and edges, is affixed.

FIG. 3 depicts an alternate embodiment of back surface 18 of flexible sheet 12. As seen, pressure sensitive adhesive 44 is applied substantially across back surface 18. The arrangement of pressure sensitive adhesive 44 in this embodiment assures that flexible sheet 12 will remain firmly adhered to the wearer and further dissuades against premature removal or movement of flexible sheet 12. FIGS. 2 and 3 represent two exemplary embodiments of how the pressure sensitive adhesive may be applied to back surface 18 of flexible sheet 12. Although not shown, other embodiments which securely adhere flexible sheet 12 to the wearer will be obvious to one skilled in the art.

Another important aspect of this invention is shown in FIG. 4 in which protective overlays are arranged without the addition of any release sheets. In this embodiment, a protective overlay dispensing system is generally shown at 50. System 50 consists of a plurality of flexible sheets 52 arranged in a stack. FIG. 4 illustrates an exemplary embodiment of one such stack 54 in which flexible sheets 52 are vertically disposed such that each flexible sheet is superimposed on another flexible sheet. Each of the flexible sheets 52 has a front surface 56 and a back surface 58 and is similar to flexible sheet 12 described in FIGS. 1–3. Flexible sheets 52, however, do not employ release sheet 14 shown in FIG. 1. Instead, each of the flexible sheets 52 is adhered to another flexible sheet within stack 54. In this regard, a first or top flexible sheet 60 has its back surface 58 (not shown) adhered to front surface 56 (not shown) of a second flexible sheet 62. Front surface 56 of each flexible sheet is formed from a material able to repeatedly adhere to a pressure sensitive adhesive 64 (shown as a dashed line) located on back surface 58 of each flexible sheet. Top flexible sheet 60 may be separated from second flexible sheet 62 and stack 54 for use. Thereafter, once top flexible sheet 60 is used, it may be re-adhered to second flexible sheet 62 or, alternatively, discarded.

Tyvek®, Reprofilm®, and Sontera® films, for example, are polymeric papers that can have a PSA applied to one side while the other side retains its release properties. Alternatively, front surface 56, then, may be formed from a release material which then is laminated to an adhesive backing or is treated to exhibit release properties for enabling the pressure sensitive adhesive of another flexible sheet to repeatedly adhere thereto. In fact, a double-sided adhesive sheet could be laminated to a polymeric film or paper sheet (e.g., Tyvek®, Reprofilm®, and Santera® films) to form the inventive protective overlay.

FIG. 5 depicts an alternate embodiment of stack 54 shown in FIG. 4. In FIG. 5, a protective overlay dispensing system is shown generally at 70. System 70 has a plurality of flexible sheets 72 arranged in a stack 74 formed as a roll. Each of the flexible sheets 72 has a top portion 76 and a bottom portion 78 and are generally similar to flexible sheets 12 described in FIGS. 1–3. Stack 74 may be housed or stored in a container or housing 80 which is, for example, made from paper-board, card-board, polymeric material, combination thereof, or the like. Two flexible sheets 82*a* and 82*b* are shown extending from stack 74. A bottom portion 78*a* of flexible sheet 82*a* is adjacent to a top portion 76*b* of flexible sheet 82*b* such that stack 74 is formed from a continuous roll of flexible sheets 72. In this regard, flexible sheets 72 of stack 74 are preferably attached at adjacent ends, as shown with bottom portion 78*a* attached to top portion 76*b*. A perforated line 86 is provided in order to separate one flexible sheet from stack 74. Bottom portion 78*a* of flexible sheet 82*a*, for example, may be pulled and thus separated from top portion 76*b* of flexible sheet 82*b* along perforated line 86. Thereafter, flexible sheet 82*a* may be discarded or re-adhered onto stack 74 and subsequently re-used.

Flexible sheets 52 shown in FIG. 4 and flexible sheets 72 shown in FIG. 5 have a pressure sensitive adhesive similar to the flexible sheet illustrated in FIG. 2. It will be appreciated, however, that the pressure sensitive adhesives of FIGS. 4 and 5 may be formed having alternative configurations such that the flexible sheets are adhered to one another to form a stack. One such alternative is shown in FIG. 3 in which the pressure sensitive adhesive is applied to substantially all the back surface of each flexible sheet.

Since certain changes may be made in the above apparatus without departing from the scope of the invention herein involved, all matter contained in the above description or shown in the accompanying drawing shall be interpreted as illustrative and not in a limiting sense.

I claim:

1. A bib for protecting clothing worn by a wearer, comprising:

(a) a flexible sheet having a front surface, a back surface, a periphery, two shoulder portions, and a top portion having a neck recess portion centrally located between said two shoulder portions; and (b) a pressure sensitive adhesive applied to substantially all of said back surface for adhering said flexible sheet to the wearer, wherein said bib is packaged with instructions relating to using said bib for protecting the clothing of the wearer.

2. The bib of claim 1 in which said neck recess portion is U-shaped.

3. The bib of claim 1 in which said flexible sheet is formed from a high density polyethylene.

4. The bib of claim 1 in which said flexible sheet is generally rectangularly shaped.

5. The bib of claim 1 which further comprises a release sheet adhered to said pressure sensitive adhesive of said back surface, said release sheet being removable from said pressure sensitive adhesive.

6. The bib of claim 1 in which said flexible sheet is formed from a transparent material.

7. The bib of claim 1 in which said flexible sheet is printed with a graphic, said graphic being selected from the group consisting of designs, emblems, alpha-numeric characters, prints, and combinations thereof.

8. A bib dispensing system, comprising:

a plurality of bibs arranged in a stack formation wherein a first said bib is releasably adhered to a second said bib, each said bib comprising:

(a) a flexible sheet having a front surface, a back surface, a periphery, two shoulder portions, and a top portion having a neck recess portion centrally located between said two shoulder portions; and (b) a pressure sensitive adhesive applied to substantially all of said back surface for adhering said flexible sheet to the wearer, wherein said bib dispensing system is packaged with instructions relating to using each said bib for protecting the clothing of the wearer.

9. The system of claim 8 in which said first bib is superimposed on said second bib to form a vertical stack.

10. The system of claim 8 in which after said back surface of said first bib is removed from said front surface of said bib, said back surface of said first bib may be re-adhered to said front surface of said second bib.

11. The system of claim 8 in which each said bib includes a top portion and a bottom portion, wherein said bottom portion of said first bib is adjacent said top portion of said second bib to form a roll stack.

12. The system of claim 8 in which each one of said bibs is attached to an adjacent said bib to form a continuous roll of said protective bibs.

13. A method for protecting clothing worn by a wearer, comprising the steps of:

(a) providing a bib comprising:

(i) a front surface, a back surface, a periphery, two shoulder portions, and a top portion having a neck recess portion centrally located between said two shoulder portions, and (ii) a pressure sensitive adhesive applied to substantially all of said back surface for adhering said bib to the wearer; and (b) adhering said pressure sensitive adhesive back surface to the clothing of the wearer.

14. The method of claim 13 further comprising the steps of:

(a) providing a plurality of said bibs in a stack formation having a first bib and a second bib, wherein said back surface of said first bib is releasably adhered to said front surface of said second bib;

(b) removing said first bib from said second bib; and (c) removing said first bib from said stack.

* * * * *